United States Patent [19]

Phillips

[11] 4,142,850

[45] Mar. 6, 1979

[54] NON-KNEEING SPINNING ORIFICES FOR SPINNERETS

[75] Inventor: Bobby M. Phillips, Kingsport, Tenn.

[73] Assignee: Eastman Kodak Company, Rochester, N.Y.

[21] Appl. No.: 538,068

[22] Filed: Jan. 2, 1975

[51] Int. Cl.[2] ..... B29F 3/04

[52] U.S. Cl. ..... 425/461; 425/464

[58] Field of Search ..... 425/461, 464; 264/177 F

[56] References Cited

U.S. PATENT DOCUMENTS

| | | | |
|---|---|---|---|
| 3,640,670 | 2/1972 | Paliyenko et al. | 425/382.2 |
| 3,738,789 | 6/1973 | Shemdin | 425/464 |

FOREIGN PATENT DOCUMENTS

| | | | |
|---|---|---|---|
| 269130 | 11/1929 | Italy | 425/464 |

*Primary Examiner*—Roy Lake
*Assistant Examiner*—John McQuade
*Attorney, Agent, or Firm*—Malcolm G. Dunn; D. B. Reece, III

[57] ABSTRACT

An essentially non-kneeing spinneret construction for spinning inelastic materials in which each spinning orifice of non-round cross-section is so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile;

$(V)_{centroid}$ is the centroid of the velocity profile;

$\int_A$ is the integral over the orifice cross-sectional area;

$V^2$ is the square of the velocity at any radius vector location r;

r is the radius vector from the origin of any set of orthogonal coordinate axes to any point r within the orifice cross-section;

dA is the differential area element.

10 Claims, 7 Drawing Figures

THE EFFECT OF CHANGING THE VARIABLE NORMALIZED "b" DIMENSION ON KNEEING FROM A "T" SHAPED CROSS-SECTION ORIFICE HAVING ONE AXIS OF SYMMETRY

THE EFFECT OF CHANGING THE VARIABLE NORMALIZED "b" DIMENSION ON KNEEING FROM A "T" SHAPED CROSS-SECTION ORIFICE HAVING ONE AXIS OF SYMMETRY

SELECTED T'S WHERE THE NORMALIZED "d" DIMENSION IN THE "T" SHAPED CROSS-SECTION ORIFICE HAVING ONE AXIS OF SYMMETRY IS VARIED

NON-KNEEING SPINNING ORIFICES FOR SPINNERETS

BACKGROUND OF THE INVENTION

This invention concerns the formation in spinnerets of holes or orifices of non-round cross-section having one axis or no axis of symmetry in the plane of the spinneret face; the holes or orifices being so formed as to eliminate non-axisymmetric emergence behavior in the spinning of inelastic materials, i.e., to eliminate "kneeing" of filaments as they are extruded from the spinning orifices. These "knees" have sometimes been called "bent filaments" or "dog legs".

In the textile art, the extrusion of filaments from orifices having essentially a round cross-section is known. Orifices of other cross-sectional configurations, however, have also been employed because the resulting extruded filaments have exhibited certain desirable and advantageous physical and aesthetic properties over the filaments extruded through round cross-sectioned orifices. The properties affected may concern resiliency and stiffness, bulk and cover, hand and the like; optical properties such as dullness, sparkle, brightness and the like; and yarn frictional properties and the like.

The extrusion of filaments from non-round cross-sections especially wherein the orifice configuration has only one axis or no axis of symmetry in the plane of the orifice cross-section, usually tends to be more difficult because of the propensity of filaments, when extruded through such orifices, to knee or form dog legs and drips or blobs.

A filament "knees" when the line of flow of the extruded filament from the orifice is bent out of the vertical back toward the spinneret face at an angle relative to the perpendicular to the spinneret face. In some instances the filament is bent to such extent that the filament forming material bends back and touches the spinneret face. This leaves a drip or blob of material on the spinneret face which can sometimes block a spinning orifice and interfere with filament formation. Sometimes such "kneeing" results in the coalescence of two or more adjacent filaments.

Some approaches toward elimination of kneeing of filaments that have been spun from spinneret orifices of noncircular cross-section taken by the prior art are shown in U.S. Pat. Nos. 3,640,670, 3,652,753 and 3,738,789.

U.S. Pat. No. 3,640,670 asserts for one of its embodiments that kneeing can be substantially eliminated in the use of T-shaped orifices by reversing the direction of the stem of the T so that the stem of the T points away from the center of a spinneret rather than toward the center of the spinneret. Another of the embodiments provides in a spinneret "split T" orifices wherein the crossbars and stem of the T are constructed by forming two rectangular orifices separated by a gap of such dimension that the resulting extrusions coalesce to form a single filament as though being spun from an integral T-shaped orifice. The resulting coalescence is due to the "Barus effect" because the extruded materials will expand at the exit and come into contact with each other. The more elastic the material being extruded the easier it is to utilize the Barus effect to cause coalescence because of the greater expansion of the material at the exit of the orifice. In U.S. Pat. No. 3,640,670, if one happens to select a T-shape which naturally knees toward the leg of the T and places it in a configuration such that the pattern is radial with all T legs pointing away from the spinneret center, then kneeing will be reduced. One is simply taking advantage of the decrease in melt viscosity, i.e., decreased resistance to flow, with increasing radius, i.e., a consequence of thermal instability. However, if one happens to choose a T shape which naturally knees toward the bar of the T and places it in the same configuration, kneeing will be more severe. Thus, opposite conclusions about the effect of the T orientation on the spinnerette face can be made, depending upon the T selected.

U.S. Pat. Nos. 3,652,753 and 3,738,789 together present still another approach, the first disclosing a process and the latter, a division of the first, disclosing a spinneret. These patents assert that kneeing can be controlled and virtually eliminated by constructing a T-shaped orifice so that the "extrusion factor" thereof as determined by the viscous resistance ratio of stem to crossbar is within a defined numerical range. The "viscous resistance" is defined as the ratio of pressure drop across the particular section of the orifice to the volume rate of flow through the orifice, and may be expressed as a function of the side wall dimensions of each rectangular segment of the T-shaped orifice. The two patents illustrate a T-shaped cross-section with "a" being the length of the crossbar section, "b" being the width of the crossbar section, "c" being the length of the leg or stem or tail portion and "d" being the width of the leg. The "viscous resistance" of the crossbar section of the orifice is thus expressed as a function of $ab^3$, and the "viscous resistance" of the leg or stem or tail portion of the T-shaped orifice is expressed as a function of $cd^3$. In the preferred embodiments, kneeing is said to be reduced through a T-shaped orifice wherein the crossbar and stem segments are essentially rectangular and wherein the stem segment is normal to the midpoint of the crossbar by constructing the orifice so that its ratio of $ab^3/cd^3$ is about 0.65 to 0.90 or more, preferably about 0.75 to 0.80 and most preferably about 0.78.

In the ratio of $ab^3/cd^3$ of the two U.S. Pat. Nos. 3,738,789 and 3,652,753, the numerator represents the resistance of flow offered by the rectangle making up the bar of the T, whereas the denominator represents the resistance to flow offered by the rectangle making up the leg of the T. This ratio is an indicator of the relative volumetric throughputs for the leg and bar of the T. It does not, however, take into account the interaction at the intersection of the rectangles. This means, therefore, that the ratio cannot be the only ratio. It can be shown that in the ratio as the dimension "b" (the width of the cross-bar section) approaches zero, the resulting orifice becomes a rectangle through which the extruded filament does not knee. Similarly, as the dimension "a" (the length of the crossbar section) approaches zero, the resulting orifice becomes a rectangle through which the extruded filament does not knee; and likewise, as the dimension "c" (the length of the leg) approaches zero, the resulting orifice becomes a rectangle through which the extruded filament does not knee. Thus, it would appear that several nonkneeing situations exist outside the specified range indicated in the two patents. On the other hand, it can also be shown that, for instance, when the normalized T dimensions are a = 1, b = 1 13/20, c = 6 and d = 9 13/20, the resulting extrusion factor in the ratio $ab^3/cd^3$ is 0.84, which is within the claimed range of the patents but provides an orifice through which it has been found that the extruded filament severely knees.

SUMMARY OF THE INVENTION

The invention concerns a solution to kneeing problems in spinnerets having orifices of non-round cross-section, each orifice having no axis or only one axis of symmetry in the plane of the spinneret face, and where the polymer material being spun is of an inelastic material.

An example of an orifice having one axis of symmetry, non-round cross-section, would be a T-shaped cross-section with the leg of the T being perpendicular to the bar of the T and intersecting the bar at its midpoint. A bisector extending through the bar and leg would form two symmetrical halves with the "bisector" constituting the "axis" of the one axis of symmetry. In this example, there are no other possible axes of symmetry in the plane of the spinneret face.

An example of a non-round cross-sectional orifice having no axis of symmetry in the plane of the spinneret face would be a polygonal configuration having more than four sides, each side of the polygon intersecting at right angles with an adjacent side.

It should be understood that in each example the orifice has the same shape or configuration throughout its capillary length, and is dimensionally constant or the same throughout the length of the capillary.

The invention is thus directed to a spinneret in which each non-round cross-sectioned spinning orifice having one axis or no axis of symmetry in the plane of the spinneret face is so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are coincident at each orifice exit so that the flow of the extruding material from the orifice has axisymmetric emergence behavior, where $(V^2)_{centroid}$ is the centroid of the square of the velocity profile;

$(V)_{centroid}$ is the centroid of the velocity profile;

$\int_A$ is the integral over the orifice cross-sectional area;

$V^2$ is the square of the velocity at any radius vector location $\vec{r}$;

r is the radius vector from the origin of any set of orthogonal coordinate axes to any point r within the orifice cross-section; and dA is the differential area element.

The velocity profile may be measured by a commercially available laser velocimeter instrument. The instrument is focused at any point in the spinning orifice cross-section at its exit or in the plane of the spinneret face to measure the velocity of the material being extruded. A series of measurements are made at predetermined points in the orifice cross-section to develop the velocity profile. The coordinates of the centroid of the square of the velocity profile and of the centroid of the velocity profile are then calculated in accordance with the equation given above. A trial and error procedure is then used to isolate the desired kneeing potential by changing the dimensions of the orifice cross-section.

The invention applies to steady state laminar flows of essentially inelastic materials through spinnerets. "Steady state" means no change with respect to time in velocity or property. "Laminar flow" means parallel or streamline with essentially no intermixture of layers (if layers could be seen), as distinguished from turbulence with resultant intermixing of the "layers". The Reynolds number based on an equivalent diameter of the cross-section of the orifice is below 1000, with most cases of interest being below 10.

By "equivalent diameter" is meant four times the cross-sectional area divided by the wetted perimeter of the cross-section. For instance, if the orifice is a T-shaped cross-section, the perimeter distance around the outline of the T is added to find the "wetted perimeter".

By "essentially inelastic materials" is meant spinning materials such as in polyesters, as for instance, polyethylene terephthalate having I.V.'s (inherent viscosities) in the commercial range of 0.35 to 1.2; poly 1,4-cyclohexanedimethylene terephthalate having an I.V. in the range of 0.5 to 1.3; and polytetramethylene terephthalate having an I.V. in the range 0.5 to 1.7. Glass would also be another example of an inelastic material as well as nylons such as polyhexamethylene adipamide and polycaprolactam with I.V.'s of textile interest. In contrast, therefore, some examples of "elastic" spinning materials which are thought possibly not applicable in the practice of this invention would be polyolefins, polypropylenes, cellulose acetate solutions dissolved in acetone, and polyacrylonitrile vinylidene chloride solutions dissolved in acetone.

"Kneeing Potential" as mentioned herein is defined as the absolute value of the normalized distance between the centroid of the square of the velocity profile ($Vc^2$) and the centroid of the velocity profile (Vc), or ($Vc^2-Vc$). This is essentially the length of the arm of the moment which is causing the kneeing, and thus for constant throughput in the capillary of the orifice in the spinneret, it is a measure of the severity of the kneeing. It is well recognized that as the throughput per orifice for a fixed orifice size is decreased, the severity of kneeing will decrease since the kneeing moment is proportional to the absolute value of ($Vc^2-Vc$) times the square of the average velocity (Vavg). However, for essentially all practical cases when the absolute value of ($Vc^2-Vc$) is equal to or less than 0.03 and for normal average velocity ranging from three (3) to thirty (30) feet per minute, kneeing poses no problem. By "absolute value" is meant that on a number line, it is the distance from zero point, regardless of direction or sign. Thus, the absolute value of 7 is 7, of −7 is 7, of −4 is 4. "Absolute value" is usually indicated by bracketing a numeral with vertical lines. Thus, the statement, "The absolute value of −9 is 9" is written $|-9|=9$. Thus also, in this disclosure the absolute value of "kneeing potential" will from time to time be indicated in the following form: $|Vc^2-Vc|$, followed in turn by an equal sign (=) and a numeral or numerals, but without any indication of the numeral(s) being plus or minus.

In general, the kneeing direction will be in the direction of a line extending from the centroid of the square of the velocity profile ($Vc^2$) to the centroid of the velocity profile (Vc), as will be herein explaind by illustration.

DRAWINGS

Figure 7:
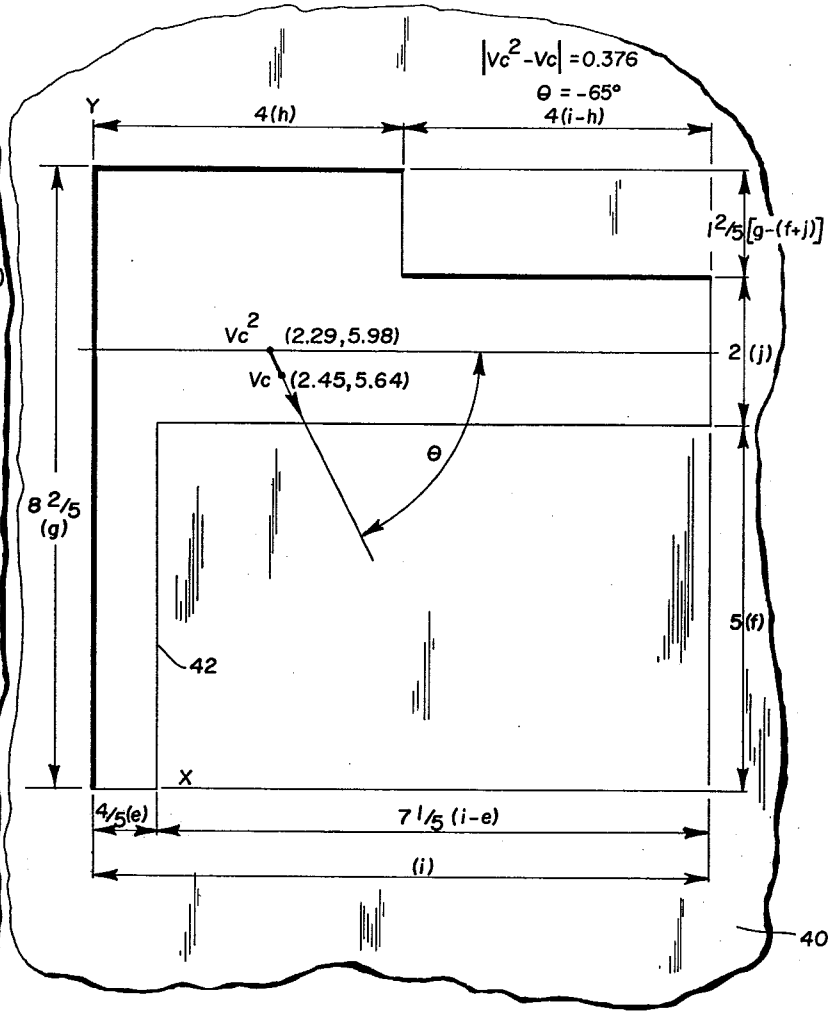
Figure 6:
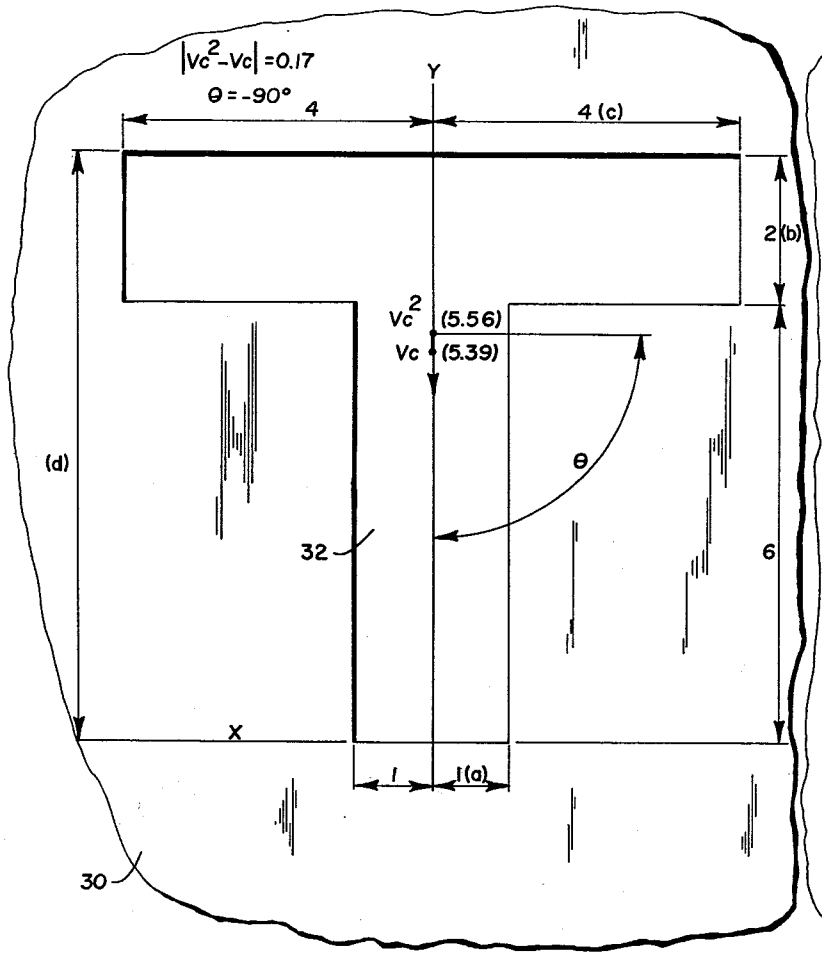

FIG. 6 is a plan view of a spinneret, shown only in part, illustrating a severely kneeing non-round spinning orifice of T-shaped cross-section having one axis of symmetry in the plane of the spinneret face, and further illustrating the orifice cross-section in relation to an X,Y coordinate system as a frame of reference for the location of the centroids, $Vc^2$ and Vc, for illustrating the kneeing direction, which is in the direction of the line extending from the point representing the centorid, $Vc^2$, to the point representing the centroid, Vc; and FIG. 7 is a plan view of a spinneret, shown only in part, illustrating a severely kneeing non-round spinning orifice having no axis of symmetry in the plane of the spinneret face, and also illustrating the orifice cross-section in relation to an X,Y coordinate system as a frame of reference for the location of the centroids, $Vc^2$ and Vc, for further illustrating the kneeing direction, which is in the direction of the line extending from the point representing the centroid, $Vc^2$, to the point representing the centroid, Vc;

DESCRIPTION OF THE PREFERRED EMBODIMENT

Figure 1:
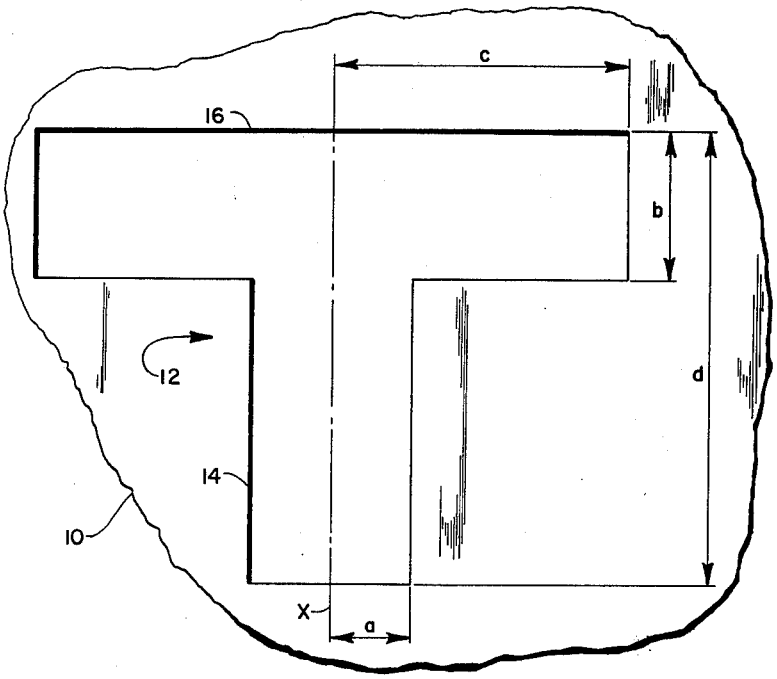
FIG. 1 is a plan view of a non-round spinning orifice of T-shaped cross-section with one axis of symmetry in a spinneret, the spinneret being shown only in part.

The spinneret, which may otherwise be of conventional construction, is shown in FIG. 1 only in part at 10 and is designed for extruding filament forming materials and having formed therein one or more spinning holes or orifices through which the materials are extruded to form filaments. The spinning orifice shown at 12 is of non-round cross-section, which in the example of FIG. 1 is T-shaped and has one axis of symmetry in the plane of the spinneret face, i.e., with respect to the axis X, the T-shaped cross-section may be divided into two equal parts, each part being the mirror image of the other part. In this instance, the leg 14 of the T-shaped cross-section is perpendicular to the bar 16 of the T-shaped cross-section and intersects the bar at its midpoint.

The invention is also applicable to a spinning orifice of nonround cross-section having no axis of symmetry in the plane of the spinneret face, as previously mentioned, and will be discussed herein with respect to the embodiments shown in FIGS. 4 and 5. Obviously, there are many other cross-sections that may be employed for a spinning orifice that may have either one axis or no axis of symmetry, so long as the orifice cross-section is dimensioned in a particular manner as disclosed herein.

Each orifice of non-round cross-section must be so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile;

$(V)_{centroid}$ is centroid of the velocity profile;

$\int_A$ is the integral over the orifice cross-sectional area;

$V^2$ is the square of the velocity at any radius vector location $\vec{r}$;

$\vec{r}$ is the radius vector from the origin of any set of orthogonal coordinate axes to any point r within the orifice cross-section;

dA is the differential area element.

In continued reference to FIG. 1, and specifically to the spinning orifice 12, the T-shaped non-round cross-section has the following dimensions:

the width of the leg = 2a,
the width of the bar = b,
the length of the bar = 2c, and
the length of th leg = d-b.

In reference to the above-indicated dimensions of the T-shaped non-round cross-sectional spinning orifice, some illustrative examples coming within the scope of the claimed invention and which are essentially non-kneeing will be given.

Figure 2:
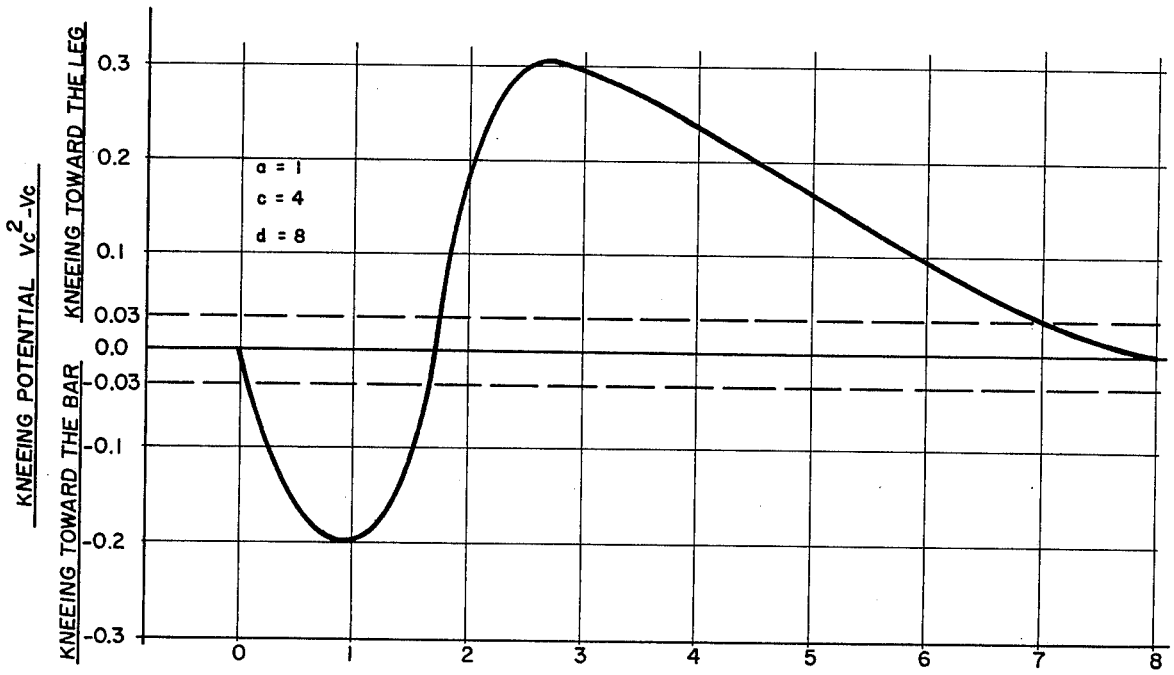
FIG. 2 illustrates a graph wherein the "b" normalized dimension of the T-shaped cross-sectioned spinning orifice shown in FIG. 1 is varied.

By "essentially non-kneeing", it is meant that a certain latitude may be allowed in which acceptable levels of kneeing may occur. This kneeing, however, would generally be considered commercially practical because there is no interference with an adjacent filament or filaments to form a coalescence. The kneeing is only to a slight extent and would normally not cause any production problem. This latitude has been found experimentally to be represented by about (±) 0.03 units in the normalized $Vc^2-Vc$ representation of kneeing potential. This is illustrated by the graph shown in FIG. 2 in which the normalized "b" dimension, for example, is varied in the T-shaped cross-sectioned orifice of FIG. 1 and the normalized dimensions "a", "c" and "d" are fixed respectively at 1, 4 and 8. In FIG. 2 it will be noted that at the points of the cross-over of the curve with the ($Vc^2-Vc$) axis there is no kneeing. By "normalized dimension" it is meant that this is a proportional relationship within the particular cross-section of the spinning orifice and not in actual units of measurement. The "kneeing potential" shown in the graph of FIG. 2 is defined as the normalized linear distance between the centroid of the square of the velocity profile ($Vc^2$) and the centroid of the velocity profile (Vc). This is simply a moment arm definition as mentioned above. It will be noticed that when "b" is equal to zero, no kneeing occurs, since the configuration of the resulting orifice cross-section is simply a rectangle. However, as "b" increases from zero, kneeing starts occurring toward the bar of the T, reaches a maximum, then passes back through zero. It then starts kneeing toward the leg of the T, reaches another maximum, and returns to zero at "b" = 8.

It is to be understood that the invention is not limited to the essentially non-kneeing examples set forth in Table I which follows:

Table I

| Example No. | a | b | c | d |
|---|---|---|---|---|
| I | 1 | 2 | 4 | $2 \leqq d \leqq 4\ 1/3$ |
| II | 1 | 1 2/3 | 3 2/3 | $1\ 2/3 \leqq d \leqq 12$ |
| III | 1 | 1 3/5 | 3 3/5 | $1\ 3/5 \leqq d \leqq 7\ 3/5$ |
| IV | 1 | 1 2/3 | 3 | $1\ 2/3 \leqq d \leqq 5\ 5/6$ |
| V | 1 | 1 3/5 | 3 | $1\ 3/5 \leqq d \leqq 12$ |
| VI | 1 | 1 4/5 | 6 | $1\ 4/5 \leqq d \leqq 12$ |
| VII | 1 | 1 2/3 | 3 5/6 | $1\ 2/3 \leqq d \leqq 7$ |
| VIII | 1 | 1 7/13 | 3 1/13 | 6 2/3 |

The fiber that is spun from each of the examples above is generally T-shaped in cross-section, and may be suitable for apparel fabrics because of improved bulk and covering capabilities.

Figure 3:
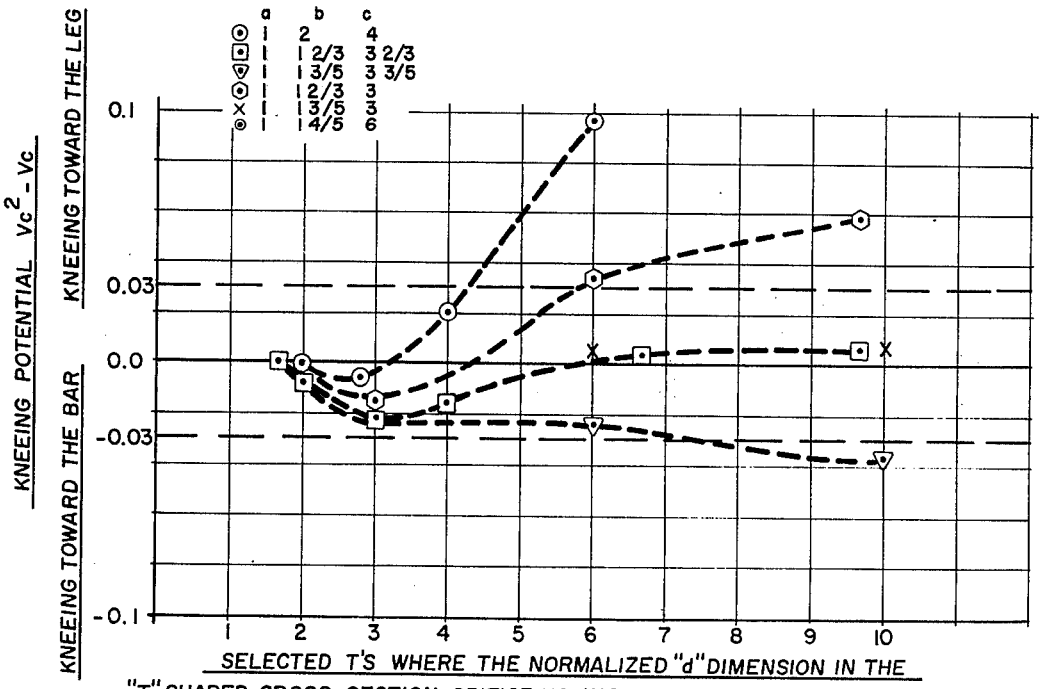
FIG. 3 illustrates a graph wherein the "d" normalized dimension of the T-shaped cross-sectioned spinning orifice shown in FIG. 1 is varied.

In FIG. 3, the illustrated graph shows the normalized "d" dimension being varied, while the normalized "a", "b" and "c" dimensions are as indicated in FIG. 3. EXAMPLES I–VI above are reflected on this graph, for instance.

Figure 4:
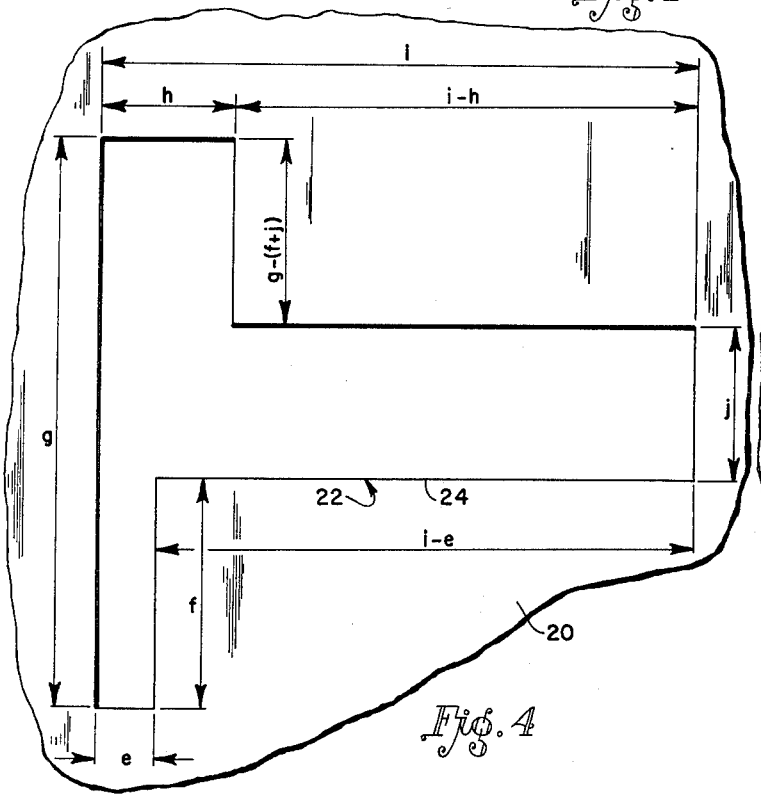
FIG. 4 is a plan view of another embodiment of a spinning orifice having a non-round cross-section with no axis of symmetry in a spinneret, the spinneret being shown only in part.

In FIG. 4 another conventionally constructed spinneret is shown only in part at 20. The spinning orifice shown at 22 is also of non-round cross-section with no axis of symmetry in the plane of the spinneret face. The configuration of the orifice cross-section can be characterized as being a polygon having more than four sides or a plurality of sides 24, each side intersecting at right angles with an adjacent side.

The polygonal configuration of orifice 22 in FIG. 4 has the following dimensions, respectively, for the sides of the polygon, as they extend in succession around the perimeter of the polygon: e, g, h, g−(f+j), i−h, j, i−e and f.

In reference to the above-identified dimensions of the polygonal cross-sectioned spinning orifice and having no axis of symmetry in the plane of the spinneret face, some further illustrative examples coming within the scope of the claimed invention and which are essentially non-kneeing will be given. As previously pointed out, "essentially non-kneeing" means that a certain latitude may be allowed in which acceptable levels of kneeing may occur, however, such slight kneeing is not sufficient as to enable a coalescence to occur of one filament with an adjacent filament or the touching of the exit surface of the spinneret. The value of (±) 0.03 units in the normalized $Vc^2-Vc$ has been found experimentally to yield acceptable non-kneeing orifices which do not have any axis in the plane of the spinneret face.

Figure 5:
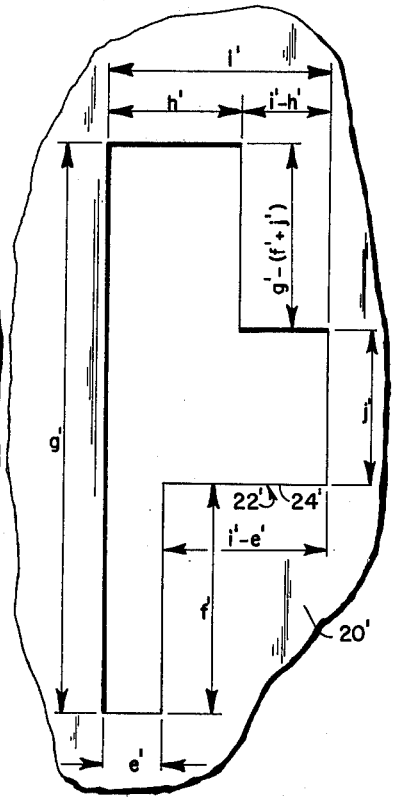
FIG. 5 is a plan view of still another embodiment of a spinning orifice having a non-round cross-section with no axis of symmetry in a spinneret, the spinneret being shown only in part.

In a comparison, therefore, of FIG. 4 with FIG. 5, one of the normalized dimensions is varied and the remaining are fixed for purposes of illustration, as for instance, the dimensions e', f', g', h' and j' are fixed and the dimension i' is varied, as shown by the non-kneeing examples in Table II.

Table II

| Example No. | e | f | g | h | i | j | $\lvert Vc^2-Vc\rvert$ |
|---|---|---|---|---|---|---|---|
| IX | 4/5 | 3 | 7 2/5 | 1 4/5 | 8 | 2 | 0.022 |
| X | 4/5 | 3 | 7 2/5 | 1 4/5 | 4 | 2 | 0.010 |

It should be recognized, of course, that other of the dimensions may also be varied.

The reference numbers and letters in FIG. 5 are the same as those in FIG. 4 but are shown with prime marks to indicate a different embodiment.

Table III is given to show how slight differences in varying one or more of the dimensions can result in an undesirable kneeing cross-sectioned orifice.

Table III

| Example No. | e | f | g | h | i | j | $\lvert V^2c-Vc\rvert$ |
|---|---|---|---|---|---|---|---|
| XI | 1 | 3 | 7 2/5 | 4 | 8 | 2 | 0.30 |

Note that dimensions h and e in Example XI were the only dimensions varied from the dimensions shown in Example IX. The slight change from the normalized dimension of 4/5 to 1 for e and 1 4/5 to 4 for h was found to result in a severely kneeing cross-sectioned orifice.

Although the embodiments of non-kneeing orifices in spinneret plates which have been illustrated thus far have been orthogonal constructions, i.e., where the intersections of the sides are at right angles with adjacent sides, it should be understood that the principles of the invention disclosed are also applicable to other cross-sectioned orifices having one or no axis of symmetry in the plane of the spinneret face. The Sims patent, U.S. Pat. No. 3,419,936, for instance, discloses a triskelion-shaped cross-section having circularly curved or arcuate branches or arms which extend from their point of connection to form a trifurcated spinning orifice. The width and length of two of the three arcuate branches may be fixed while the width and length of the third branch may be made equal to the fixed widths and lengths of the first two arcuate branches in order to get another non-kneeing spinning orifice.

As previously stated, kneeing potential is defined as the absolute value of the normalized distance between the centroid of the square of the velocity profile ($Vc^2$) and the centroid of the velocity profile (Vc), or ($Vc^2-Vc$), which is essentially the length of the arm of the moment which is causing the kneeing.

As also previously stated, in general the kneeing direction will be in the direction of the line extending from the $Vc^2$ point to the Vc point. Thus, in FIG. 6, which shows a portion of a spinneret 30 and illustrates an example of a severely kneeing T-cross-sectioned orifice 32 having one axis of symmetry, both centroid points $Vc^2$ and Vc lie only on the line bisecting the T-cross-sectioned orifice or on the coordinate axis line Y, and thus kneeing is only possible in the plus or minus Y-direction. The particular locations of the two centroids are shown by the coordinate figures, which are normalized dimensions, in parenthesis beside the centroid points. The absolute value of $Vc^2-Vc$, as shown in FIG. 6, is 0.17. This is the kneeing potential. The arrow shows that the kneeing is toward the leg of the T, and the angle $\theta$(theta) is $-90°$. The angle, theta, may be measured either clockwise (negative) or counterclockwise (positive) direction from the line shown passing through the centroid of the square of the velocity profile ($Vc^2$), which line is parallel to the x-coordinate axis.

For the non-symmetrical or no axis (in the plane of the spinneret face) cross-sectioned shapes illustrated in FIGS. 4 and 5, the kneeing direction may have both X and Y components as is the case for the polygonal configuration shown in FIG. 7. FIG. 7 shows a portion of a spinneret 40 and illustrates an example of a severely kneeing polygonal cross-sectioned spinning orifice 42 having no axis of symmetry. The arrow shows the direction of kneeing. The absolute value of $Vc^2-Vc$ is shown as being 0.376, and the angle of theta is shown as being $-65°$.

In Table IV, below, are further examples of the polygonal configuration shown in FIGS. 4, 5 and 7, where certain of the dimensions (e, f, g, h, i, j) is or are varied as shown.

Table IV

| Ex. No. | Variable* e | f | g | h | i | j | Kneeing Potential Absolute Value $\lvert V^2c-Vc\rvert$ | Angle*** |
|---|---|---|---|---|---|---|---|---|
| XII | 2 | 3 | 6 2/5 | 4 | 8 | 2 | 0.288 | −35° |
| XIII | 2 | 5 | 8 2/5 | 4 | 8 | 2 | 0.376 | −65° |
| XIV | 2 | 3 | 6 2/5 | 3 | 8 | 2 | 0.310 | −27° |
| XV | 2 | 3 | 7 2/5 | 4 | 8 | 2 | 0.305 | −47° |
| XVI | 1 | 3 | 7 2/5 | 4 | 8 | 2 | 0.298 | −25° |
| XVII | 1 | 3 | 7 2/5 | 2 | 8 | 2 | 0.076 | −23° |
| XVIII** | 4/5 | 3 | 7 2/5 | 1 4/5 | 8 | 2 | 0.022 | +90° |
| XIX** | 4/5 | 3 | 7 2/5 | 1 4/5 | 4 | 2 | 0.010 | +163° |
| XX | 4/5 | 3 | 7 2/5 | 1 4/5 | 3 | 2 | 0.033 | −135° |

*See FIG. 4 and 5.
**These shapes are essentially non-kneeing.
***Kneeing angle with reference to positive X-axis.

Note that in Table IV above, Example Nos. XVIII and XIX are the same as Example Nos. IX and X in Table II above except for the additional information concerning absolute value and the kneeing angle, theta ($\phi$).

The invention has been described in detail with particular reference to preferred embodiments thereof, but it will be understood that variations and modifications can be effected within the spirit and scope of the invention.

I claim:

1. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area $V^2$ is the square of the velocity at any radius vector location $\vec{r}$ $\vec{r}$ is the radius vector from the origin of any set of orthogonal coordinate axes to any point r within the orifice cross-section dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectioned orifice being as follows:

$a = 1$ $b = 2$ $c = 4$ $2 \leqq d \leqq 4\ 1/3$.

2. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essential coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area $V^2$ is the square of the velocity at any radius vector location $\vec{r}$ $\vec{r}$ is the radius vector from the origin of any set of orthoganol coordinate axes to any point r within the orifice cross-section dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectioned orifice being as follows:

a = 1 b = $1\frac{2}{3}$ c = $3\frac{2}{3}$ $1\frac{2}{3} \leqq d \leqq 12$.

3. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area $V^2$ is the square of the velocity at any radius vector location $\vec{r}$ $\vec{r}$ is the radius vector from the origin of any set of orthogonal coordinate axes to any point r within the orifice cross-section dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectioned orifice being as follows:

a = 1 b = 1 3/5 c = 3 3/5

$13/5 \leqq d \leqq 7\ 3/5$.

4. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area $V^2$ is the square of the velocity at any radius vector location $\vec{r}$ $\vec{r}$ is the radius vector from the origin of any set of orthogonal coordinate axes to any point r within the orifice cross-section dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectioned orifice being as follows:

a = 1 b = $1\frac{2}{3}$ c = 3

$1\frac{2}{3} \leqq d \leqq 5\ 5/6$.

5. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area $V^2$ is the square of the velocity at any radius vector location r r is the radius vector from the origin of any set of orthogonal coordinate axes to any point r within the orifice cross-section dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectioned orifice being as follows:

a = 1 b = 1 3/5 c = 3

1 3/5 ≦ d ≦ 12.

6. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area $V^2$ is the square of the velocity at any radius vector location $\vec{r}$ $\vec{r}$ is the radius vector from the origin of any set of orthogonal coordinate axes to any point r within the orifice cross-section dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectioned orifice being as follows:

a = 1 b = 1 4/5 c = 6

1 4/5 ≦ d ≦ 12.

7. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area
$V^2$ is the square of the velocity at any radius vector location $\vec{r}$
$\vec{r}$ is the radius vector from the origin of any set of orthogonal coordinate axes to any point r within the orifice cross-section
dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectioned orifice being as follows:

a = 1
b = $1\frac{2}{3}$
c = 3 5/6
$1\frac{2}{3} \leqq d \leqq 7$.

8. A spinneret for extruding filament forming materials and having formed through the face of the spinneret one or more orifices of non-round cross-section, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile
$(V)_{centroid}$ is the centroid of the velocity profile
$\int_A$ is the integral over the orifice cross-sectional area
$V^2$ is the square of the velocity at any radius vector location $\vec{r}$
$\vec{r}$ is the radius vector from the origin of any set of orthogonal coordinate axes to any point r within the orifice cross-section
dA is the differential area element, each orifice also being a T-cross-section having one axis of symmetry and wherein the width of the leg of the T-cross-section is designated 2a, the width of the bar of the T-cross-section is designated b, the length of the bar of the T-cross-section is designated 2c, and the length of the leg of the T-cross-section is designated d-b, and with the normalized dimensions of each T-cross-sectional orifice being as follows:

a = 1
b = 1 7/13
c = 3 1/13
d = 6 2/13.

9. A spinneret for extruding filament forming materials and having formed through the face of the spinneret one or more orifices of non-round cross-section, each orifice having no axis of symmetry and defining in configuration a polygon having a plurality of sides, each side of the polygon intersecting at right angles with an adjacent side, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile
$(V)_{centroid}$ is the centroid of the velocity profile
$\int_A$ is the integral over the orifice cross-sectional area
$V^2$ is the square of the velocity at any radius vector location $\vec{r}$
$\vec{r}$ is the radius vector from the origin of any set of orthogonal coordinate axes to any point r within the orifice cross-section
dA is the differential area element, and wherein each orifice has the following dimensions, respectively, for the sides of the defined polygon as they extend in succession around the perimeter of the polygon:

e
g
h
g − (f + j)
i − h
j
i − e
f and with the normalized dimensions of each said orifice being as follows:

e = 4/5
f = 3
g = 7 2/5
h = 1 4/5
i = 8 j = 2.

10. A spinneret for extruding filament forming materials and having formed through the face of the spinneret one or more orifices of non-round cross-section, each orifice having no axis of symmetry and defining in configuration a polygon having a plurality of sides, each side of the polygon intersecting at right angles with an adjacent side, each orifice being so dimensioned that the coordinates of the centroid of the square of the velocity profile of the extruding material in the plane perpendicular to the axis of the orifice, as determined by $$(V^2)_{centroid} = \frac{\int_A V^2 \vec{r}\, dA}{\int_A V^2 dA}$$

and the coordinates of the centroid of the velocity profile of the extruding material in the plane perpendicular to the axis of the orifice, as determined by $$(V)_{centroid} = \frac{\int_A V \vec{r}\, dA}{\int_A V\, dA}$$

are essentially coincident at each orifice exit so that the flow of the extruding material from the orifice has axisymmetric emergence behavior, where $(V^2)_{centroid}$ is the centroid of the square of the velocity profile $(V)_{centroid}$ is the centroid of the velocity profile $\int_A$ is the integral over the orifice cross-sectional area $V^2$ is the square of the velocity at any radius vector location $\vec{r}$ $\vec{r}$ is the radius vector from the origin of any set of orthogonal coordinate axes to any point r within the orifice cross-section dA is the differential area element, and wherein each orifice has the following dimensions, respectively, for the sides of the defined polygon as they extend in succession around the perimeter of the polygon:

e
g
h
g − (f + j)
i − h
j
i − e
f and with the normalized dimensions of each said orifice being as follows:

e = 4/5
f = 3
g = 7 2/5
h = 1 4/5
i = 4
j = 2.

* * * * *

UNITED STATES PATENT AND TRADEMARK OFFICE

CERTIFICATE OF CORRECTION

PATENT NO. : 4,142,850

DATED : March 6, 1979

INVENTOR(S) : Bobby M. Phillips

It is certified that error appears in the above-identified patent and that said Letters Patent are hereby corrected as shown below:

Column 13, Claim 5, line 30, "r" should read -- $\vec{r}$ --.

Column 13, Claim 5, line 31, "r" should read -- $\vec{r}$ --.

Signed and Sealed this

*Seventh* Day of *August 1979*

[SEAL]

*Attest:*

*Attesting Officer*

LUTRELLE F. PARKER

*Acting Commissioner of Patents and Trademarks*